US006948679B1

(12) United States Patent
Black

(10) Patent No.: US 6,948,679 B1
(45) **Date of Patent: *Sep. 27, 2005**

(54) MATERIAL DISPENSER SYSTEM

(75) Inventor: Charles D. Black, Williston, ND (US)

(73) Assignee: New Product Marketing Corporation, Williston, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/723,351

(22) Filed: Nov. 26, 2003

Related U.S. Application Data

(63) Continuation-in-part of application No. 09/996,666, filed on Nov. 28, 2001, now Pat. No. 6,659,390.

(60) Provisional application No. 60/436,483, filed on Dec. 24, 2002.

(51) Int. Cl.[7] ..... B65H 65/00; B65H 75/28
(52) U.S. Cl. ..... 242/588.2; 242/597.4
(58) Field of Search ..... 242/588.1, 588.2, 242/597.4, 597.6

(56) References Cited

U.S. PATENT DOCUMENTS

| | | | | |
|---|---|---|---|---|
| 1,825,822 | A | 10/1931 | Rundell | |
| 2,171,648 | A | 9/1939 | Ennis et al. | |
| 2,632,605 | A | 3/1953 | Lee | |
| 3,346,208 | A | 10/1967 | Hoffman et al. | |
| 3,347,485 | A | 10/1967 | Bundschuh | |
| 3,612,423 | A | 10/1971 | Bahnsen | 424/55.42 |
| 4,235,389 | A | 11/1980 | Ness | |
| 4,714,211 | A | 12/1987 | Hwang | |
| 5,125,586 | A | 6/1992 | Whitethorn | |
| 5,328,115 | A | 7/1994 | Samuelson et al. | 242/588.6 |
| 5,370,339 | A | 12/1994 | Moody et al. | 242/597.6 |
| 5,577,686 | A | 11/1996 | Moody | 242/597.4 |
| 5,683,058 | A | 11/1997 | Schwarz et al. | 424/578.2 |
| 5,775,632 | A | 7/1998 | Huerta | 242/597.6 |
| 5,842,655 | A | 12/1998 | McCarthy | 242/129 |
| 6,257,298 | B1 | 7/2001 | Huang | 156/577 |
| 6,302,177 | B1 | 10/2001 | Gruber | 156/527 |
| 6,457,669 | B1 | 10/2002 | Chuang | 424/588.2 |
| 6,659,390 | B2 * | 12/2003 | Black | 242/588.2 |
| 2001/0042810 | A1 | 11/2001 | Christensen et al. | 242/597.2 |
| 2002/0070308 | A1 | 6/2002 | Fahringer | 242/423.2 |

FOREIGN PATENT DOCUMENTS

| | | |
|---|---|---|
| EP | 0156468 | 10/1985 |
| EP | 0300695 | 11/1989 |
| GB | 2065070 | 6/1981 |
| GB | 2209325 | 5/1989 |

* cited by examiner

*Primary Examiner*—William A. Rivera
(74) *Attorney, Agent, or Firm*—Michael S. Neustel

(57) ABSTRACT

A material dispenser system for allowing convenient unloading, loading and dispensing of a spool of elongate material. The material dispenser system includes a plurality of prongs formed for rotatably receiving a spool of material, a main body receiving the prongs, and a handle attached to the main body. The prongs are comprised of a resilient material for allowing the distal portions thereof to be forcibly contracted thereby allowing the spool of material to be unloaded and a replacement spool to be loaded. The prongs each have a flanged portion that extends outwardly thereby retaining the spool positioned upon the prongs.

19 Claims, 17 Drawing Sheets

MATERIAL DISPENSER SYSTEM

CROSS REFERENCE TO RELATED APPLICATIONS

I hereby claim benefit under Title 35, United States Code, Section 119(e) of U.S. provisional patent application Ser. No. 60/436,483 filed Dec. 24, 2002 which is still pending. I hereby claim benefit under Title 35, United States Code, Section 120 of U.S. patent application Ser. No. 09/996,666 filed Nov. 28, 2001, now U.S. Pat. No. 6,659,390. This application is a continuation-in-part of the 09/996,666 application. The 09/996,666 application is currently pending. The 09/996,666 application and the 60/436,483 application are hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to elongate material dispensers and more specifically it relates to a material dispenser system for allowing convenient unloading, loading and dispensing of a spool of elongate material.

2. Description of the Related Art

Elongate material dispensers have been in use for years. Conventional elongate materially dispensers are formed for receiving and dispensing a spool of material such as barricade tape, flagging tape, string, rope, wire and other elongate materials. The BEN MEADOWS COMPANY manufactures a barricade tape dispenser that is comprised of a complex structure which is difficult to load and unload a spool of material. There are other products on the market that receive and dispense elongate material upon a spool, but they are relatively difficult to load and unload.

While these devices may be suitable for the particular purpose to which they address, they are not as suitable for allowing convenient unloading, loading and dispensing of a spool of elongate material. Conventional material dispensing devices are difficult to load and unload with a spool of material.

In these respects, the material dispenser system according to the present invention substantially departs from the conventional concepts and designs of the prior art, and in so doing provides an apparatus primarily developed for the purpose of allowing convenient unloading, loading and dispensing of a spool of elongate material.

BRIEF SUMMARY OF THE INVENTION

In view of the foregoing disadvantages inherent in the known types of elongate material dispensers now present in the prior art, the present invention provides a new material dispenser system construction wherein the same can be utilized for allowing convenient unloading, loading and dispensing of a spool of elongate material.

The general purpose of the present invention, which will be described subsequently in greater detail, is to provide a new material dispenser system that has many of the advantages of the elongate material dispensers mentioned heretofore and many novel features that result in a new material dispenser system which is not anticipated, rendered obvious, suggested, or even implied by any of the prior art elongate material dispensers, either alone or in any combination thereof.

To attain this, the present invention generally comprises a plurality of prongs formed for rotatably receiving a spool of material, a main body receiving the prongs, and a handle attached to the main body. The prongs are comprised of a resilient material for allowing the distal portions thereof to be forcibly contracted thereby allowing the spool of material to be unloaded and a replacement spool to be loaded. The prongs each have a flanged portion that extends outwardly thereby retaining the spool positioned upon the prongs.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a material dispenser system that will overcome the shortcomings of the prior art devices.

A second object is to provide a material dispenser system for allowing convenient unloading, loading and dispensing of a spool of elongate material.

A second object is to provide a material dispenser system for allowing efficient replacement of a spool of elongate material.

Another object is to provide a material dispenser system that is easy to load and unload a spool of material.

An additional object is to provide a material dispenser system that may be utilized with spools of material such as but not limited to barricade tape, flagging tape, string, rope, wire and other elongate materials.

A further object is to provide a material dispenser system that is ergonomic thereby reducing stress upon the user's fingers and wrist during usage.

Another object is to provide a material dispenser system that allows a user to easily sever a desired length of the elongate material.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
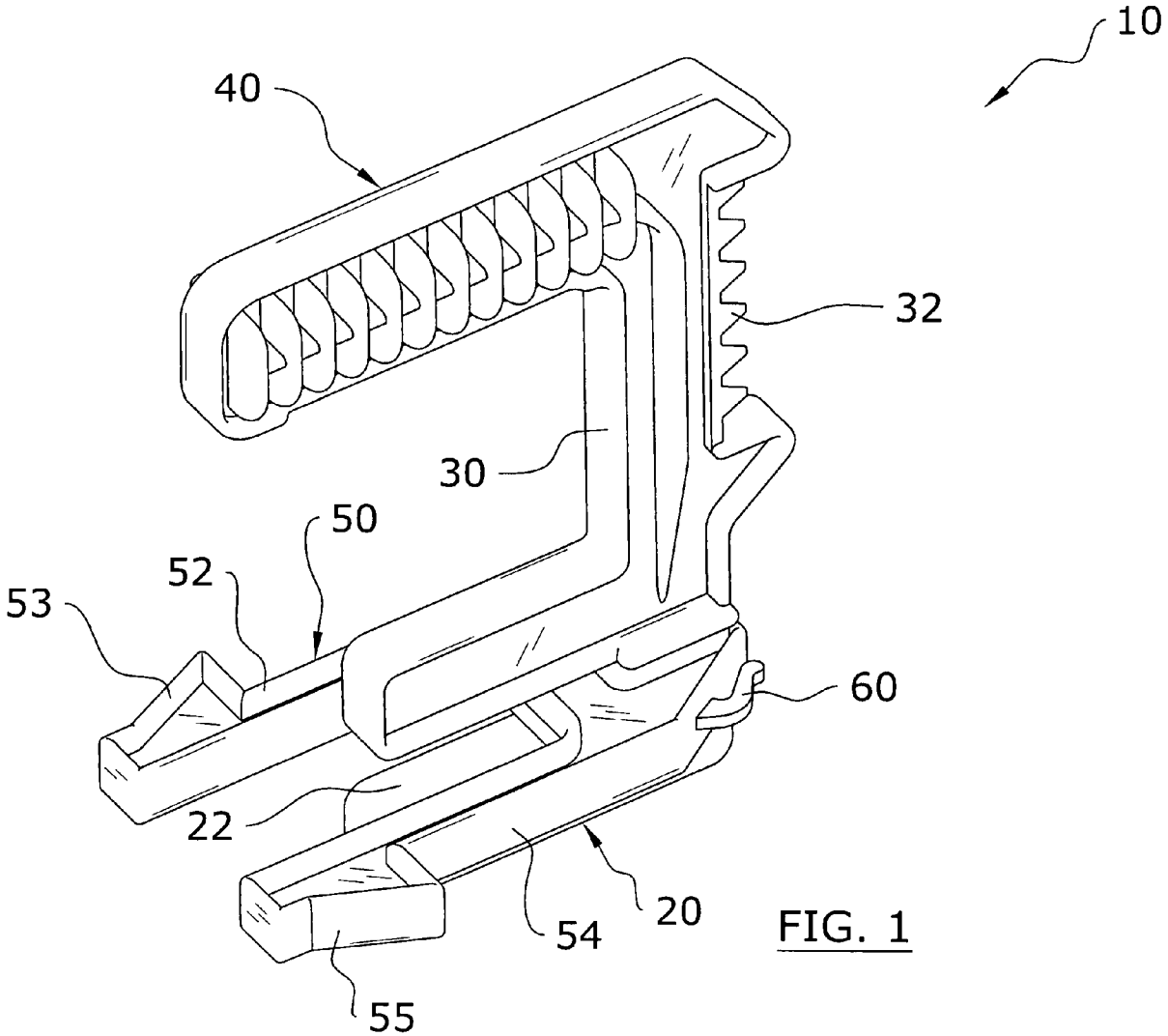
FIG. 1 is an upper perspective view of the present invention.

Turning now descriptively to the drawings, in which similar reference characters denote similar elements throughout the several views, FIGS. 1 through 17 illustrate a material dispenser system 10, which comprises a plurality of prongs 50 formed for rotatably receiving a spool 12 of material, a main body 20 receiving the prongs 50, and a handle 40 attached to the main body 20. The prongs 50 are comprised of a resilient material for allowing the distal portions thereof to be forcibly contracted thereby allowing the spool 12 of material to be unloaded and a replacement spool 12 to be loaded. The prongs 50 each have a flanged portion that extends outwardly thereby retaining the spool 12 positioned upon the prongs 50.

Figure 2:
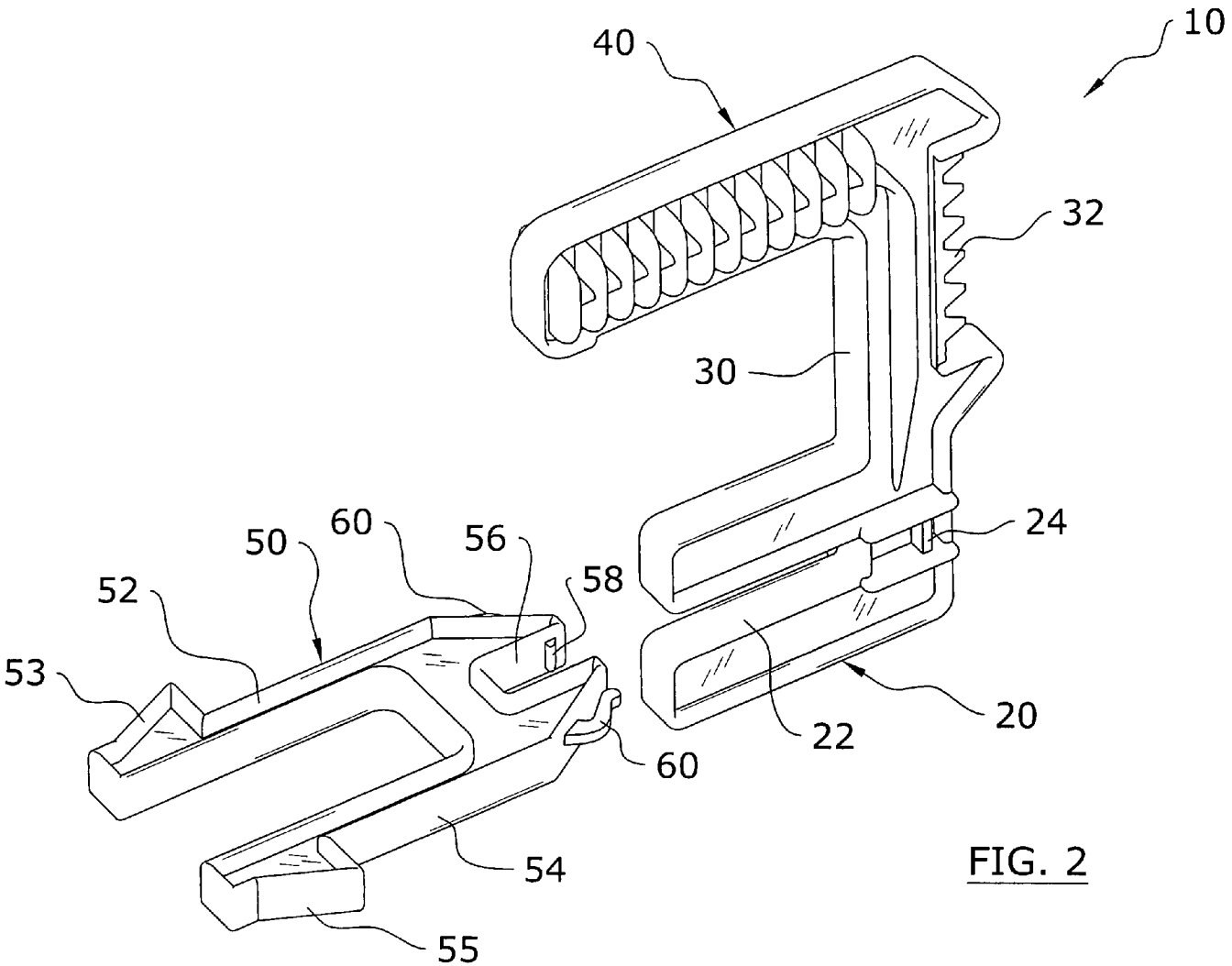
FIG. 2 is an exploded upper perspective view of the present invention.
Figure 5:
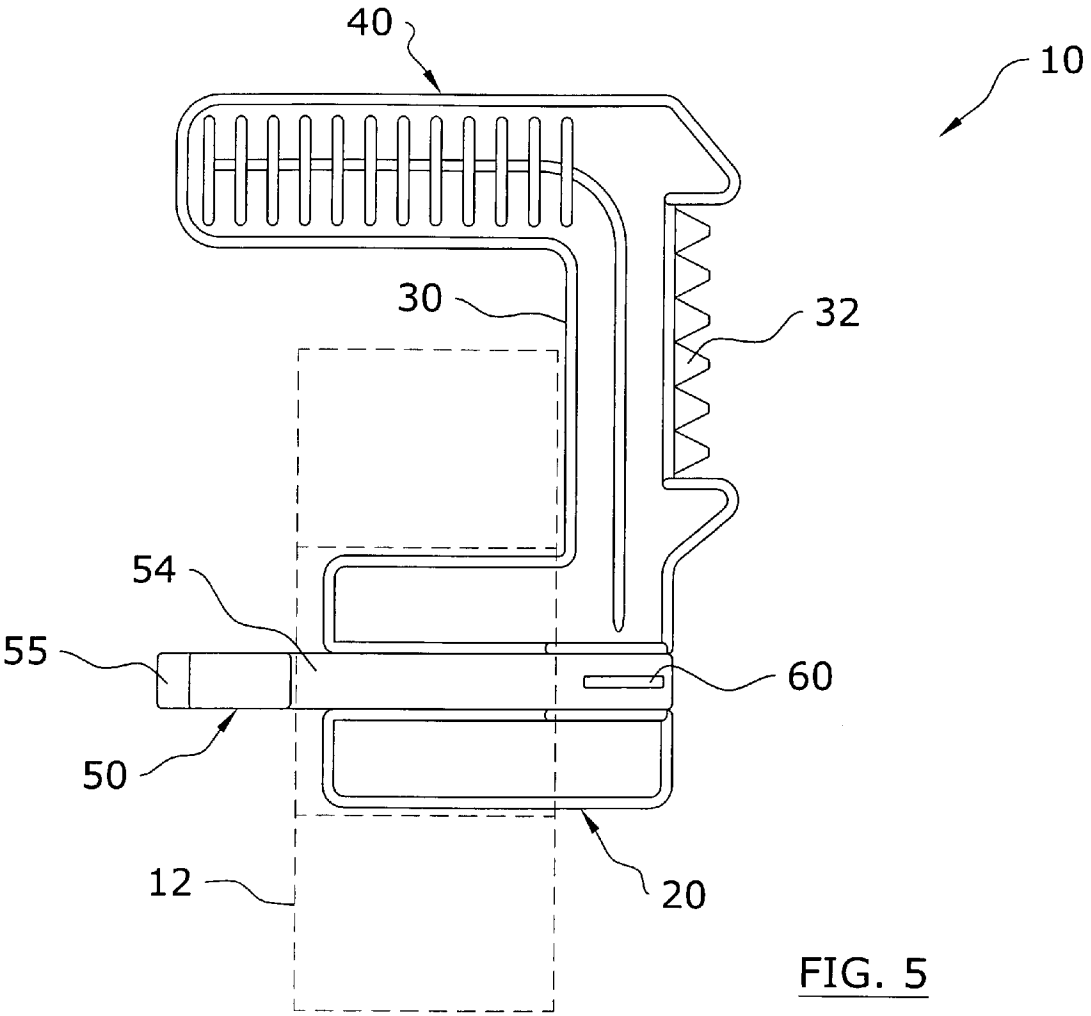
FIG. 5 is a side view of the present invention.
Figure 6:
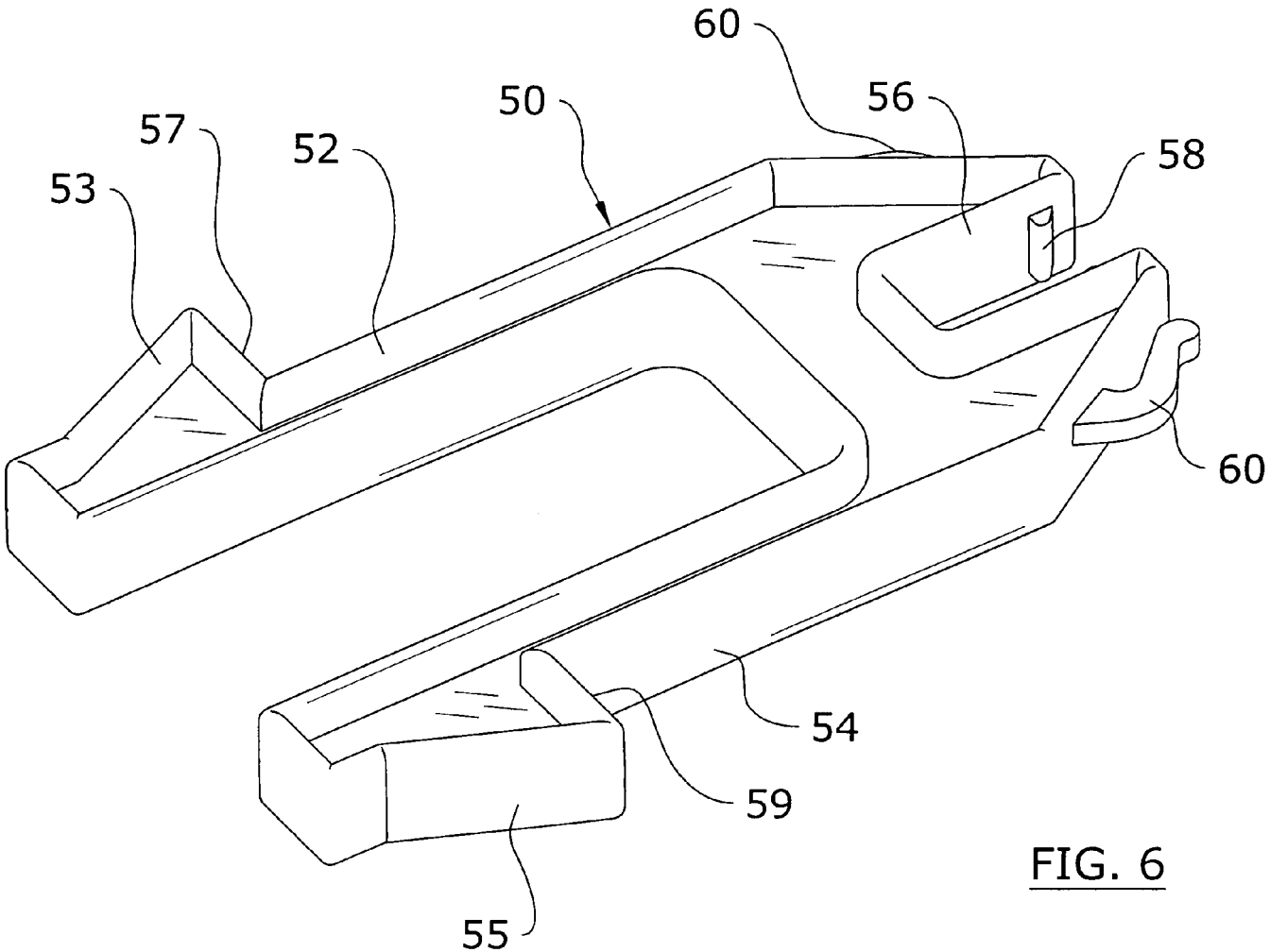
FIG. 6 is an upper perspective view of the prongs.

FIGS. 2 and 5 best illustrate the main body 20 preferably having a U-shaped structure. The main body 20 preferably has a horizontal main slot 22, however the main slot 22 may also be orientated in a vertical manner. The main body 20 preferably includes a pair of opposing catch members 24 that extend outwardly that are catchably engaged by the engaging nubs 58 of the prongs 50 as shown in FIG. 2 of the drawings.

As shown in FIGS. 1, 2 and 5 of the drawings, a support member 30 extends from the main body 20. The support member 30 preferably extends substantially transversely with respect to the main body 20 as best shown in FIG. 5 of the drawings. At least one cutting edge 32 preferably extends from the support member 30 as best shown in FIG. 5 of the drawings. The cutting edge 32 may be comprised of a plurality of blades or similar cutting structure capable of cutting the material upon the spool 12.

A handle 40 is preferably attached transversely to the distal end of the support member 30 opposite of the main body 20 as best shown in FIG. 5 of the drawings. The handle 40 preferably extends outwardly substantially parallel with respect to the main body 20 as further shown in FIG. 5 of the drawings. The handle 40 may have various ergonomic configurations for grasping by a user during loading, unloading, transporting and dispensing of elongate material from a spool 12.

Figure 7:
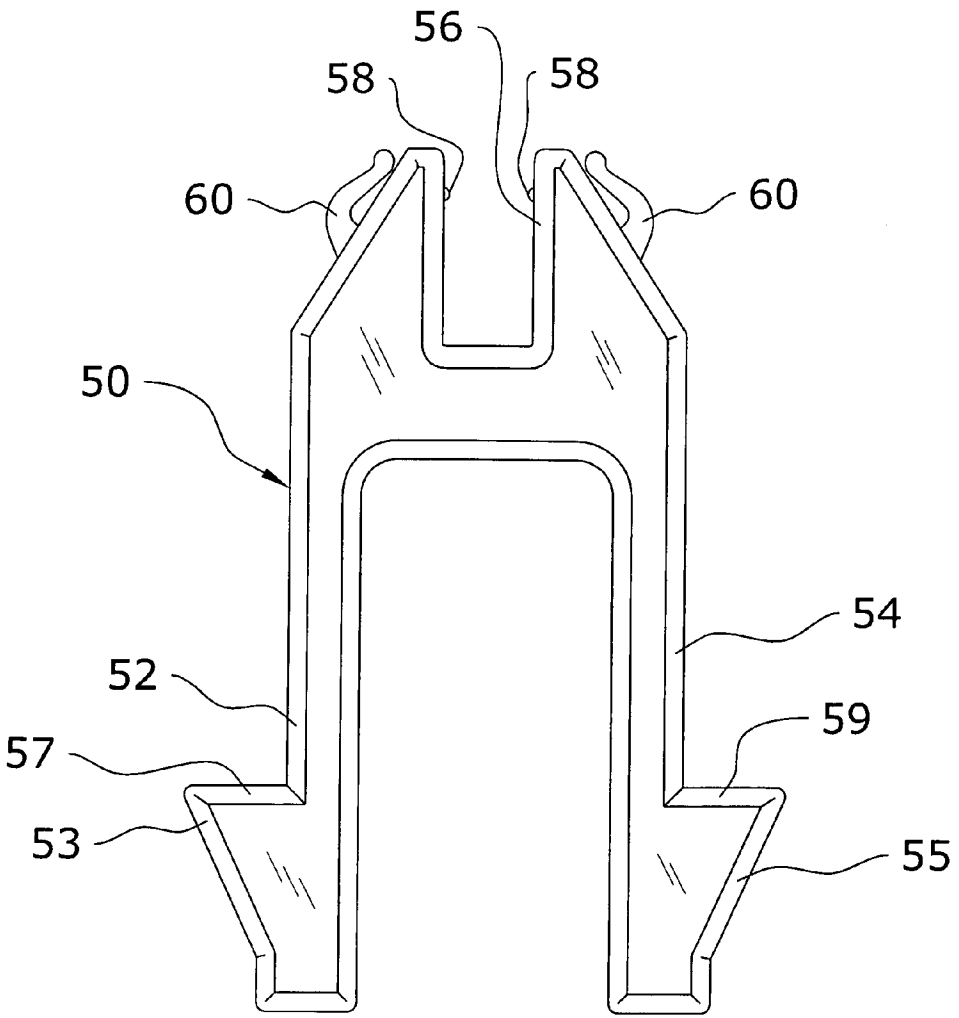
FIG. 7 is a top view of the present invention.
Figure 8:
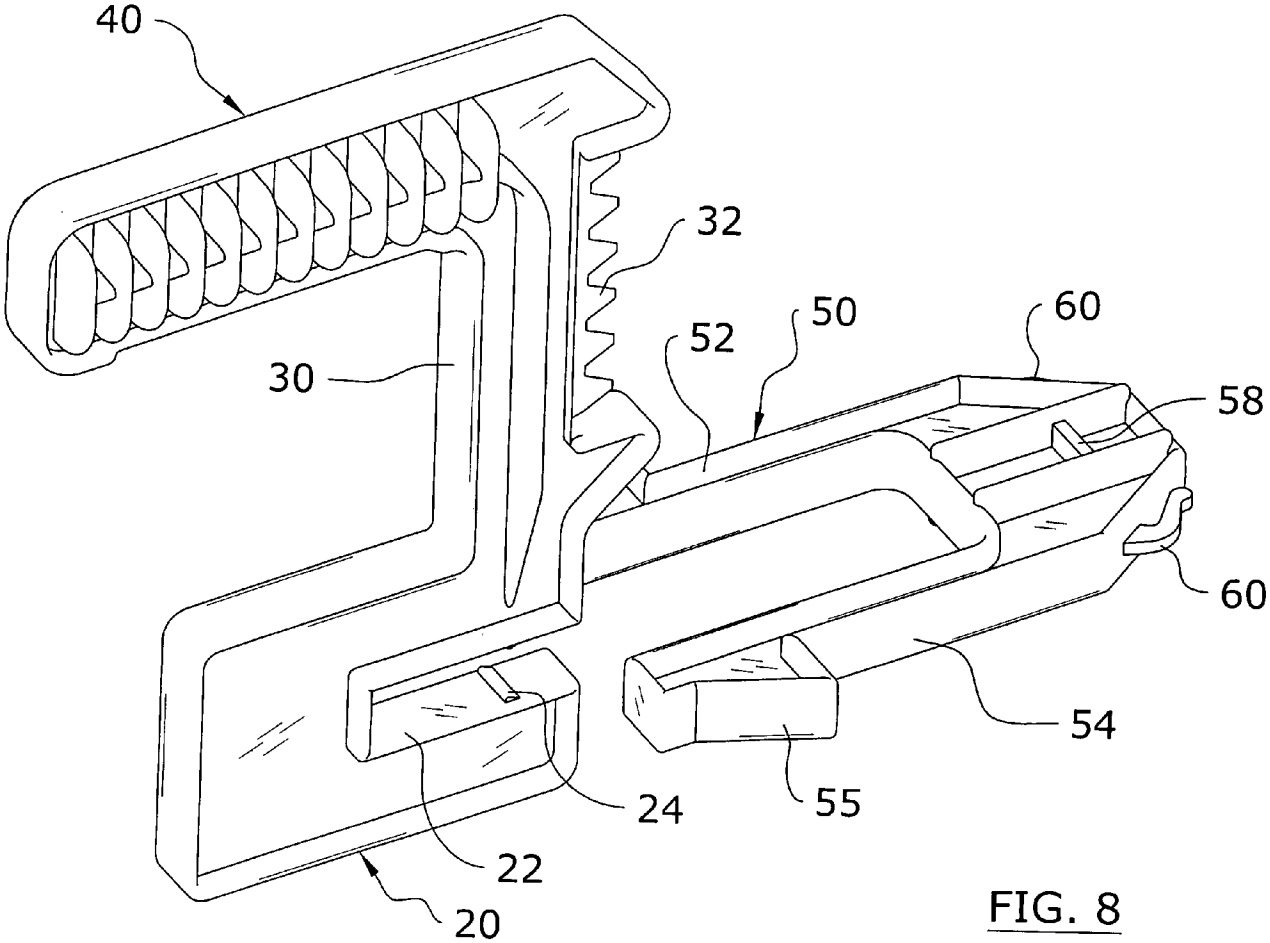
FIG. 8 is an exploded upper perspective view of a first alternative embodiment of the present invention.
Figure 9:
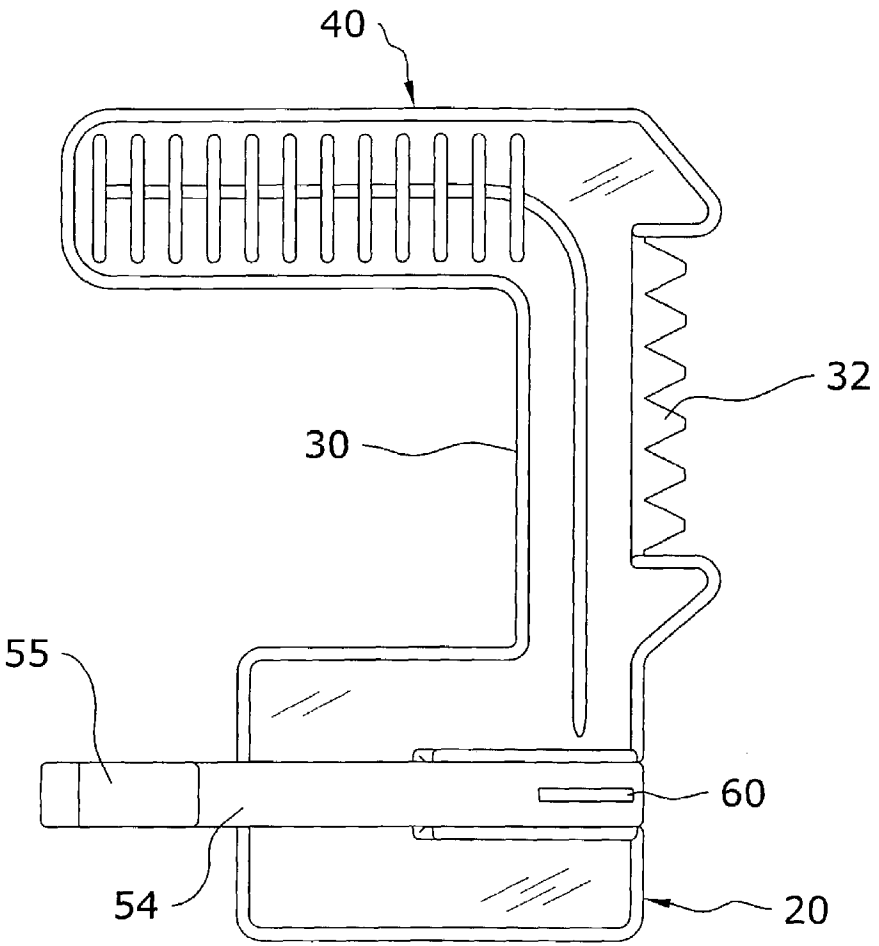
FIG. 9 is a side view of the first alternative embodiment.
Figure 10:
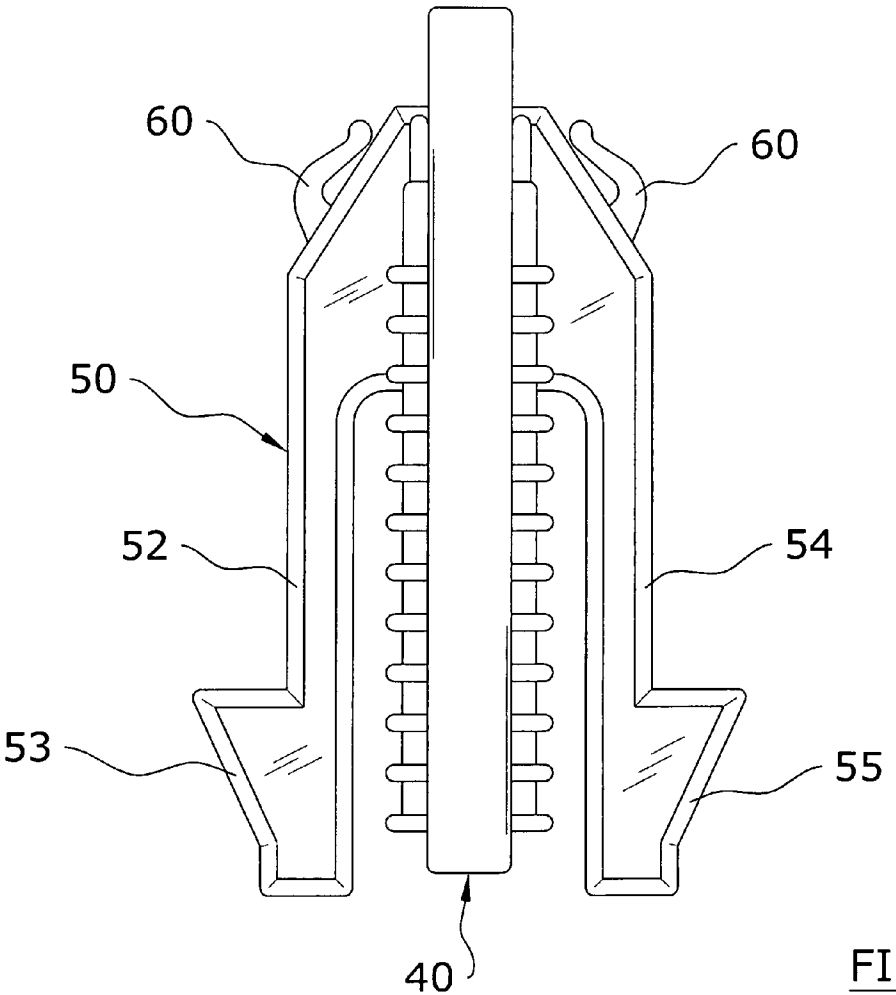
FIG. 10 is a top view of the first alternative embodiment.

As shown in FIGS. 2 and 7 of the drawings, the prongs 50 are preferably comprised of a base, and a first prong 52 and a second prong 54 extending from the base in a resilient manner and forming a U-shaped structure. The prongs 50 preferably include a first prong 52 and a second prong 54, however, it can be appreciated that additional prongs 50 may extend from the base. The prongs 50 are preferably comprised of a resilient material such as but not limited to plastic or composite material. The present invention is designed to receive and dispense conventional spools 12 of elongate material surrounding a core. The spool 12 may be comprised of other structures not illustrated in the drawings.

Figure 3:
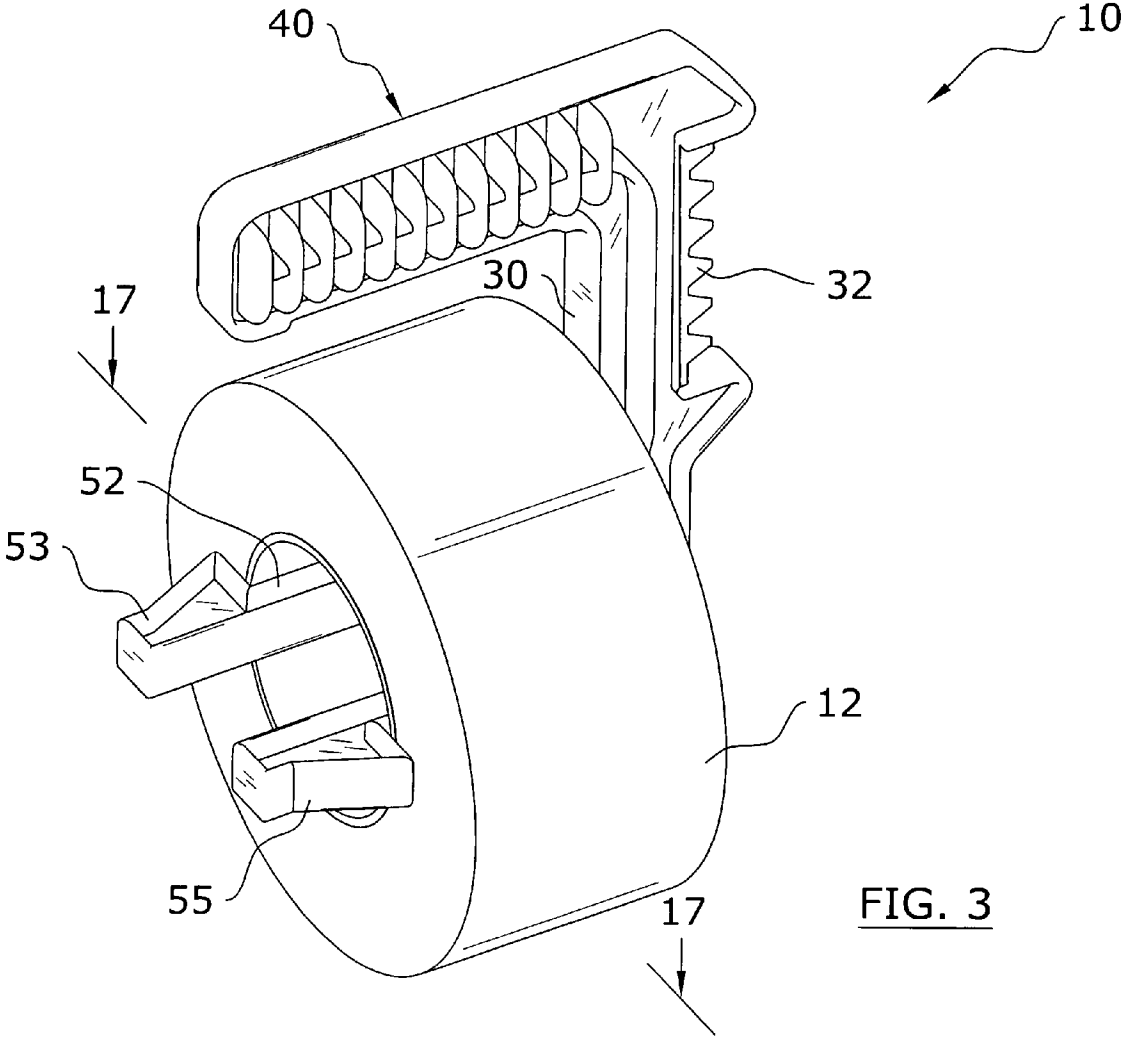
FIG. 3 is an upper perspective view of the present invention with a spool of elongate material.
Figure 4:
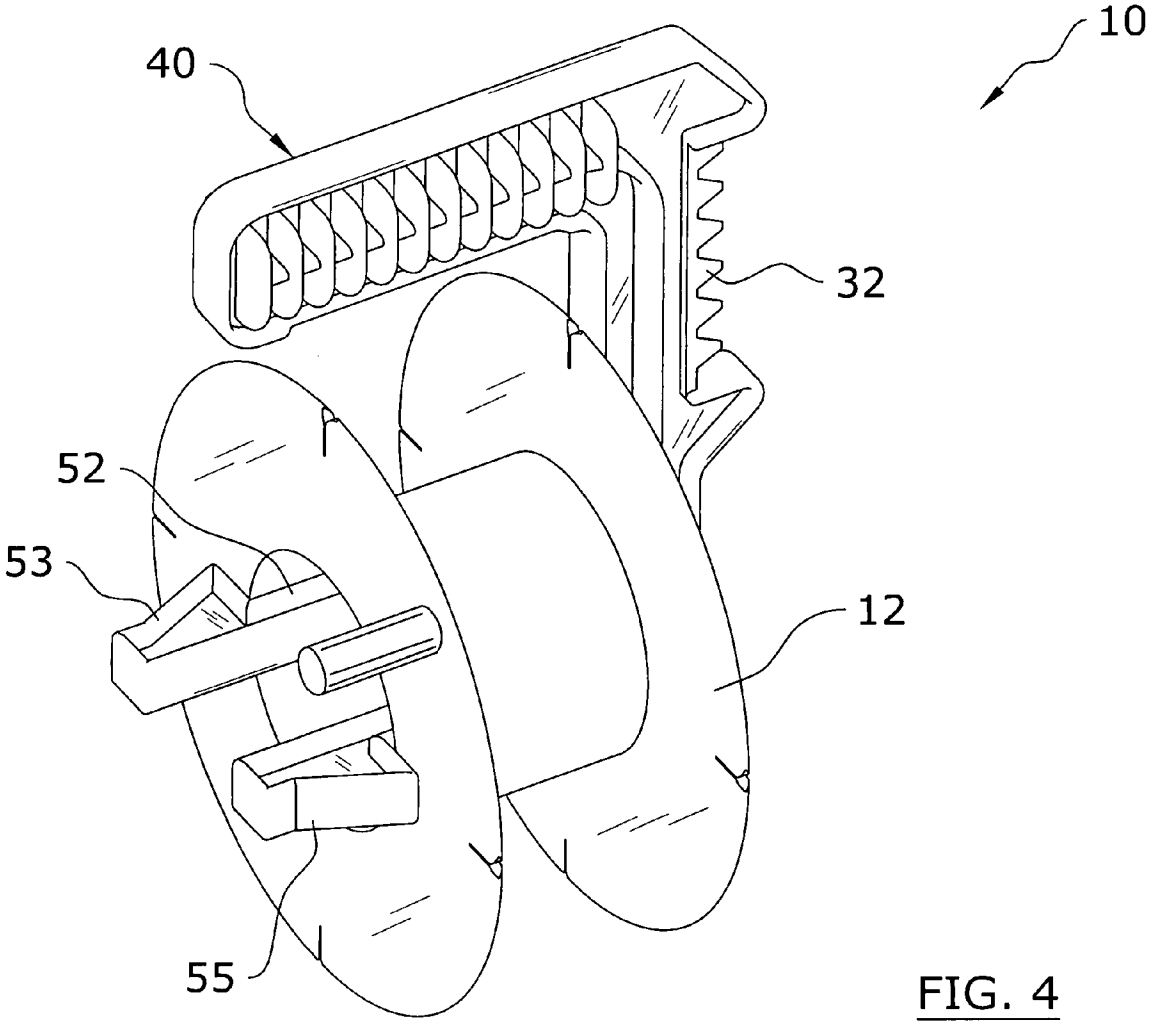
FIG. 4 is an upper perspective view of the present invention with another type of spool.

The prongs 50 receive and rotatably support a spool 12 as shown in FIGS. 3 and 4 of the drawings. The prongs 50 have a main portion positioned inwardly from the flanges 53, 55 that have a width smaller than the inner diameter of the core of the spool 12 to allow for rotation of the spool 12 about the prongs 50 as shown in FIG. 5 of the drawings.

The base of the prongs 50 preferably has a prong slot 56 extending away from the first prong 52 and the second prong 54. The prong slot 56 is formed for receiving a portion of the main body 20 as shown in FIGS. 1, 2 and 4 of the drawings. A pair of engaging nubs 58 extend inwardly within the prong slot 56 to catchably engage the catch members 24 of the main body 20.

The distal ends of each of the first prong 52 and the second prong 54 have tapered flanges 53, 55 for retaining the spool 12 of material upon the prongs 50 as shown in FIGS. 1 through 7 of the drawings. The first flange 53 and the second flange 55 are preferably tapered to allow for easy loading of the spool 12.

The first prong 52 has at least a first flange 53 extending outwardly from the distal portion thereof as best shown in FIG. 7 of the drawings. The first flange 53 has a first edge 57 that is in opposition to the spool 12 and sometimes engages the spool 12 during dispensing of elongate material. The flanges 53, 55 are preferably a sufficient distance from the spool 12 to avoid constant frictional engagement with the spool 12 during dispensing.

The second prong 54 has at least a second flange 55 extending outwardly from the distal portion thereof as best shown in FIG. 7 of the drawings. The second flange 55 has a second edge 59 that is in opposition to the spool 12 and sometimes engages the spool 12 during dispensing of the elongate material. The flanges 53, 55 may have various structures commonly utilized for flange structures. The width measured from the outer portions of the flanges 53, 55 is larger than an inner diameter of the core of the spool 12 thereby preventing the spool 12 from accidentally being removed from the prongs 50 as shown in FIG. 3 of the drawings.

One or more engaging members 60 are attached to the prongs 50 as shown in FIGS. 2 and 7 of the drawings. The engaging members 60 are for selectively engaging the distal portion of elongate material on a spool 12 to prevent accidental dispensing of the elongate material from the spool 12. The engaging members 60 may have various structures capable of frictionally retaining the elongate material between thereof and the prongs 50. One or more engaging members 60 may also be attached to the main body 20 or the support member 30 also.

Figure 11:
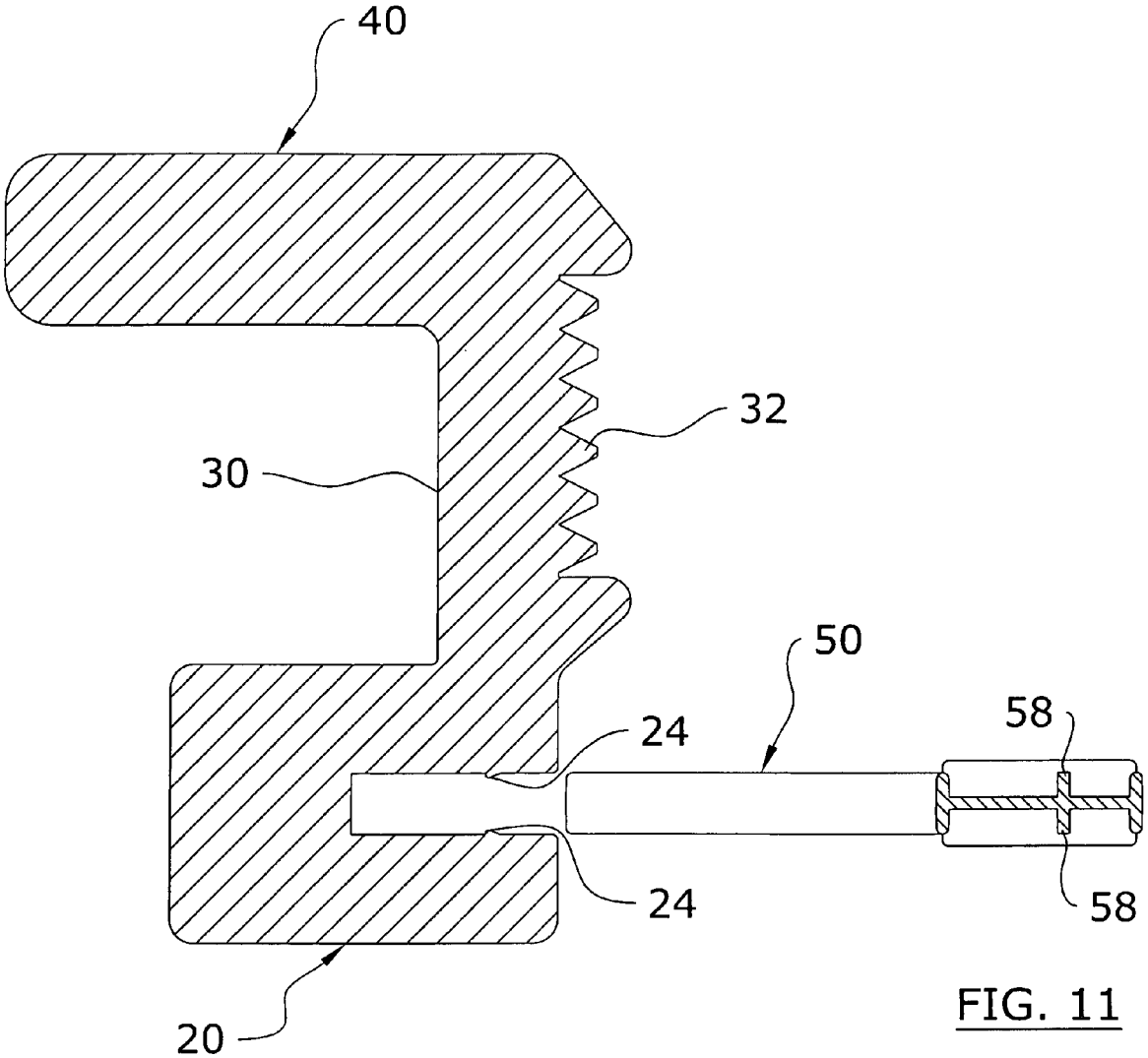
FIG. 11 is an exploded side cutaway view of the first alternative embodiment.
Figure 12:
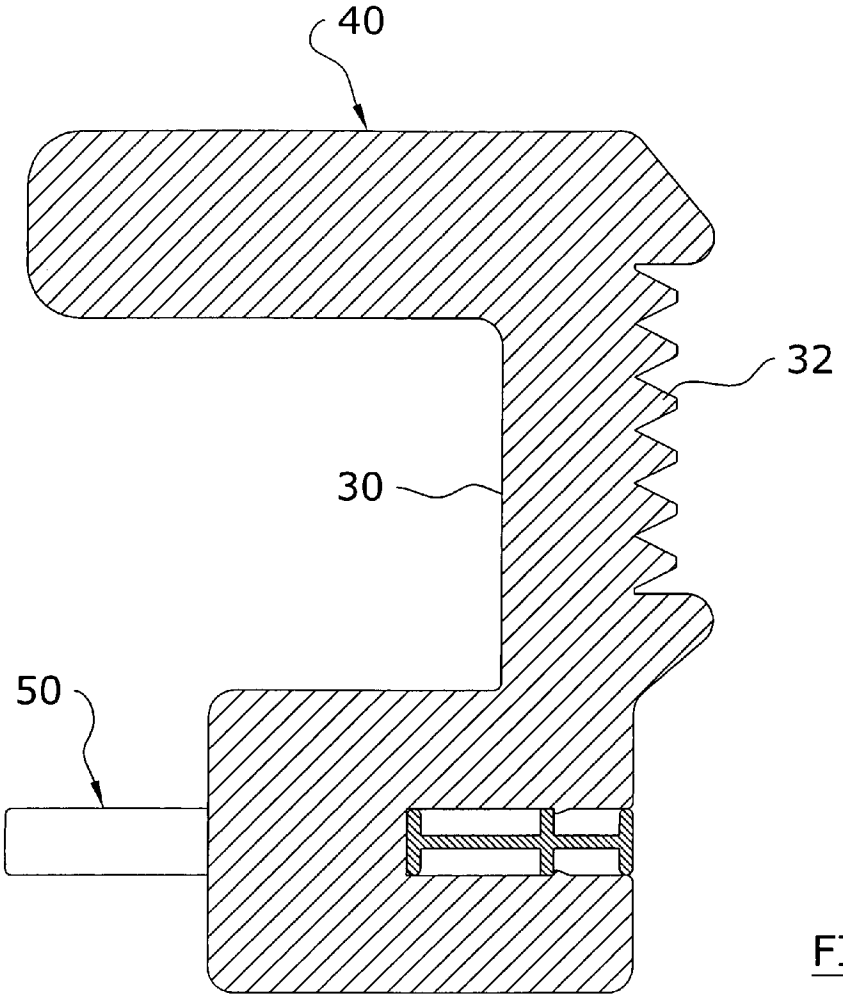
FIG. 12 is a cutaway side view of the first alternative embodiment.
Figure 13:
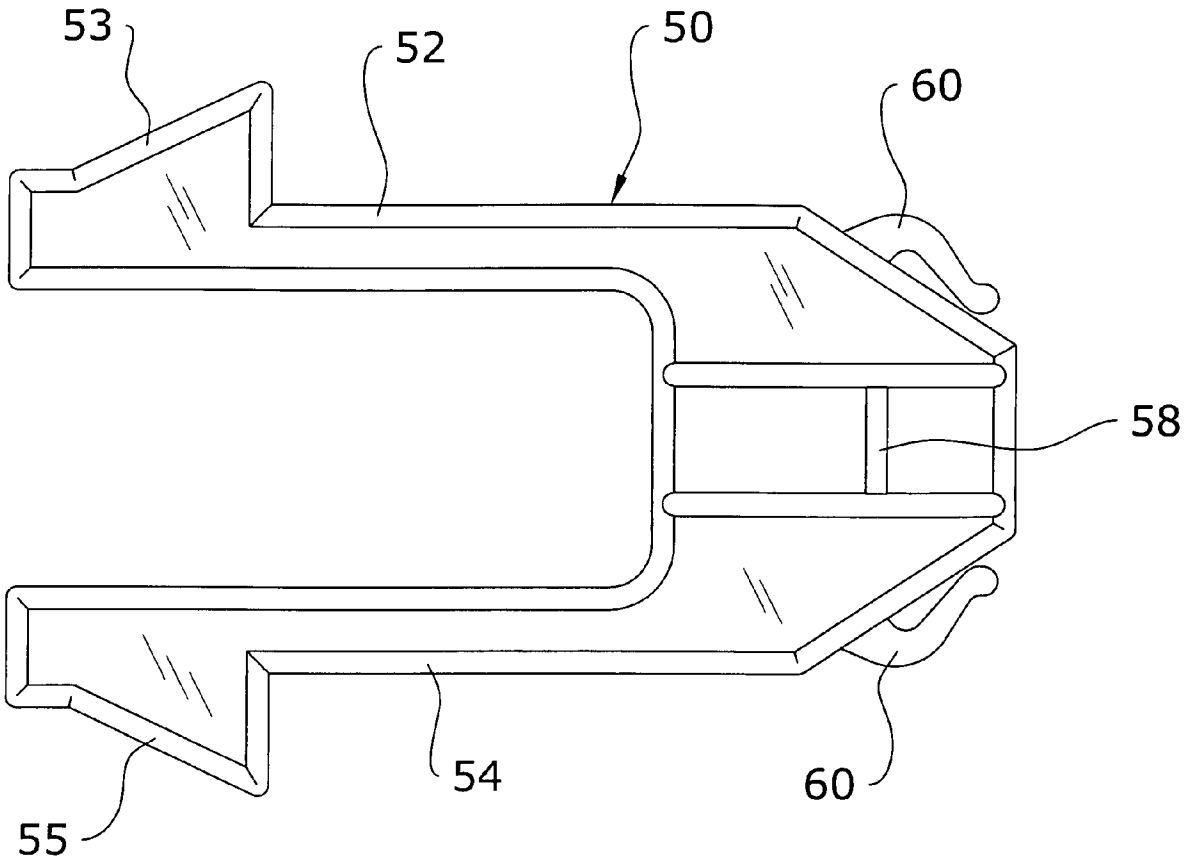
FIG. 13 is a top view of the prongs for the first alternative embodiment.

FIGS. 8 through 13 illustrate a first alternative embodiment which is similar to the main embodiment except that the main slot 22 within the main body 20 is reversed and the prongs 50 do not have a slot. FIG. 11 best illustrates the position of the catch members 24 within the main slot 22 of the main body 20. The engaging nubs 58 within the prongs 50 correspondingly match to the catch members 24 as shown in FIG. 11 of the drawings.

Figure 14:
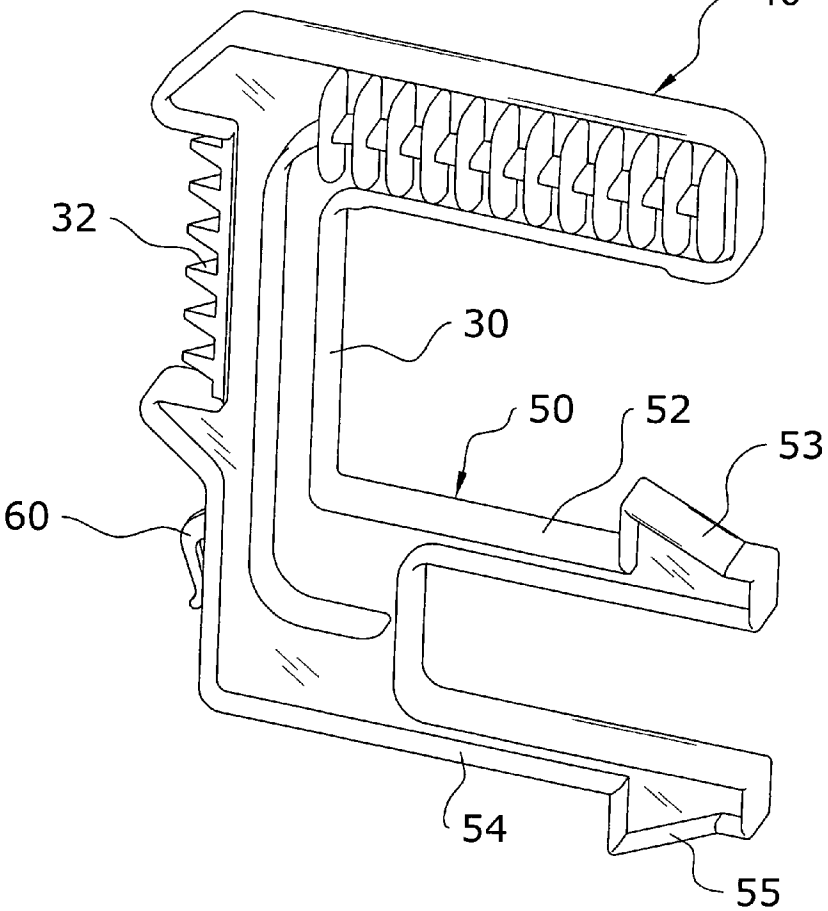
FIG. 14 is an upper perspective view of a second alternative embodiment.
Figure 15:
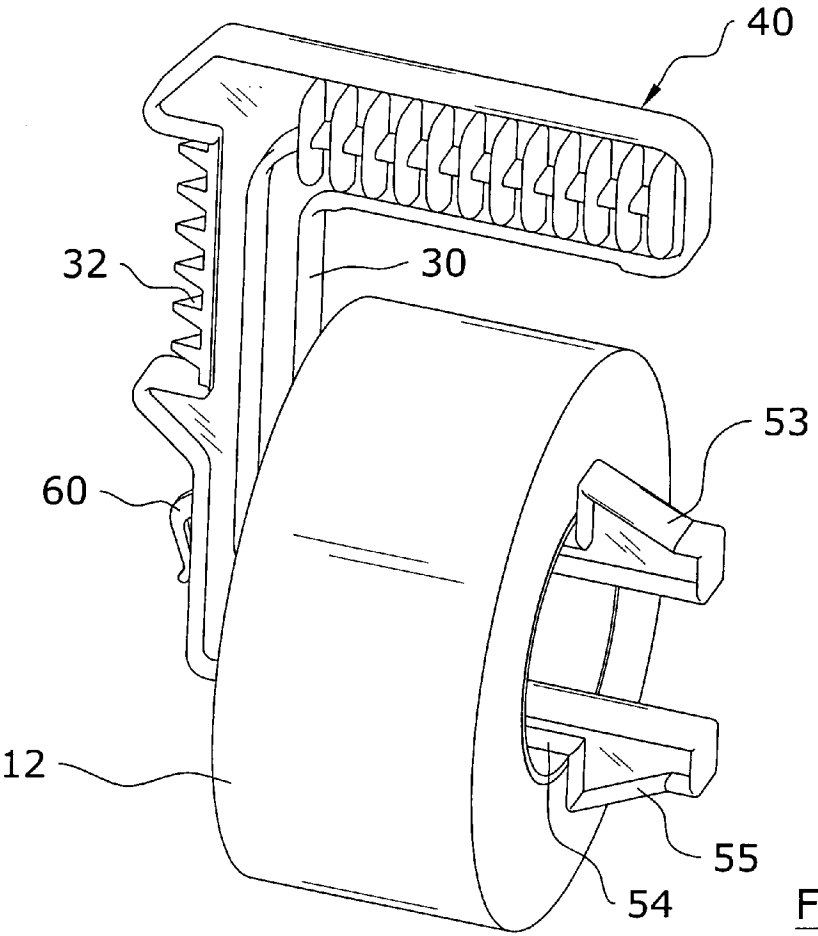
FIG. 15 is an upper perspective view of the second alternative embodiment with a spool positioned upon the prongs.
Figure 16:
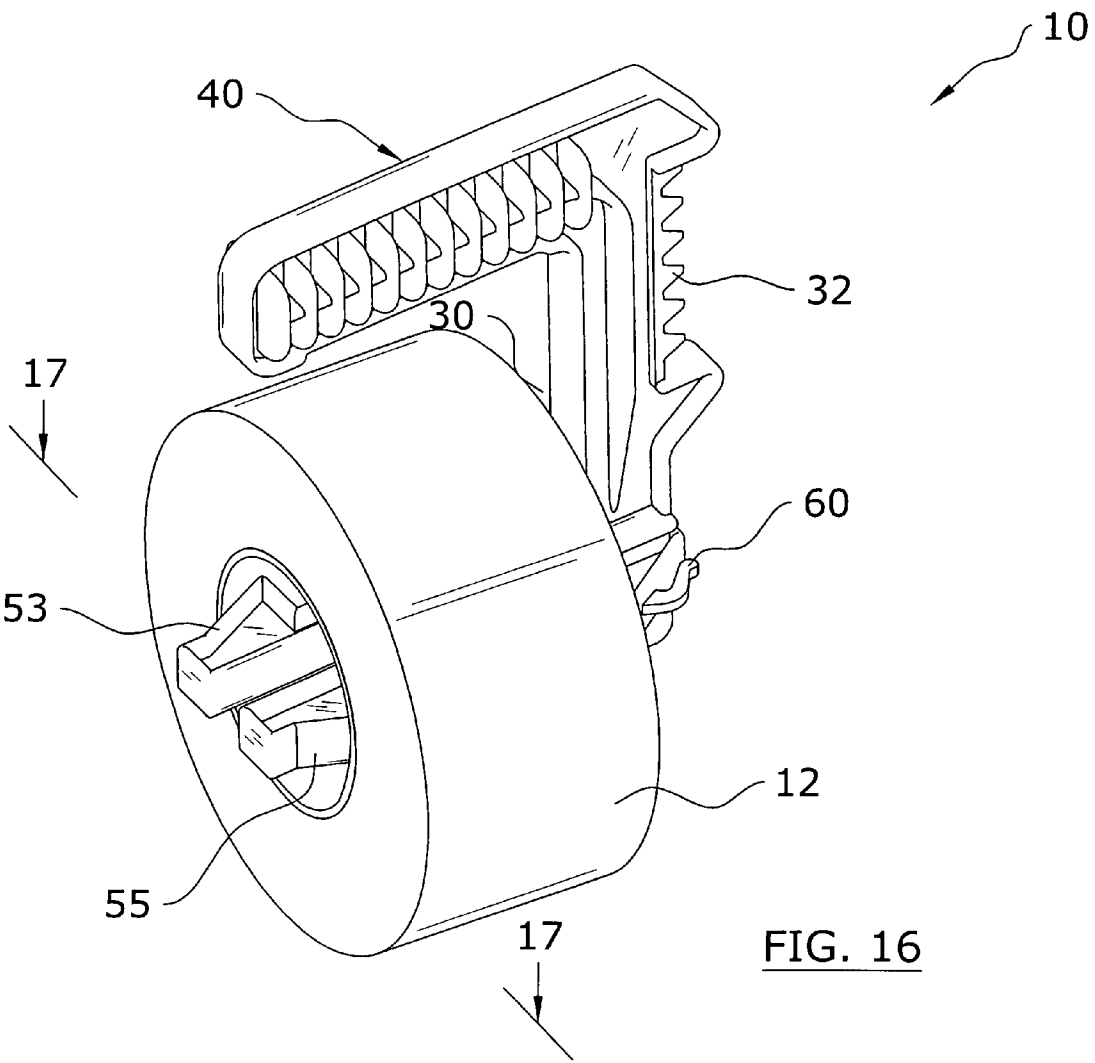
FIG. 16 is an upper perspective view of the main embodiment illustrating the spool partially positioned upon the prongs.
Figure 17:
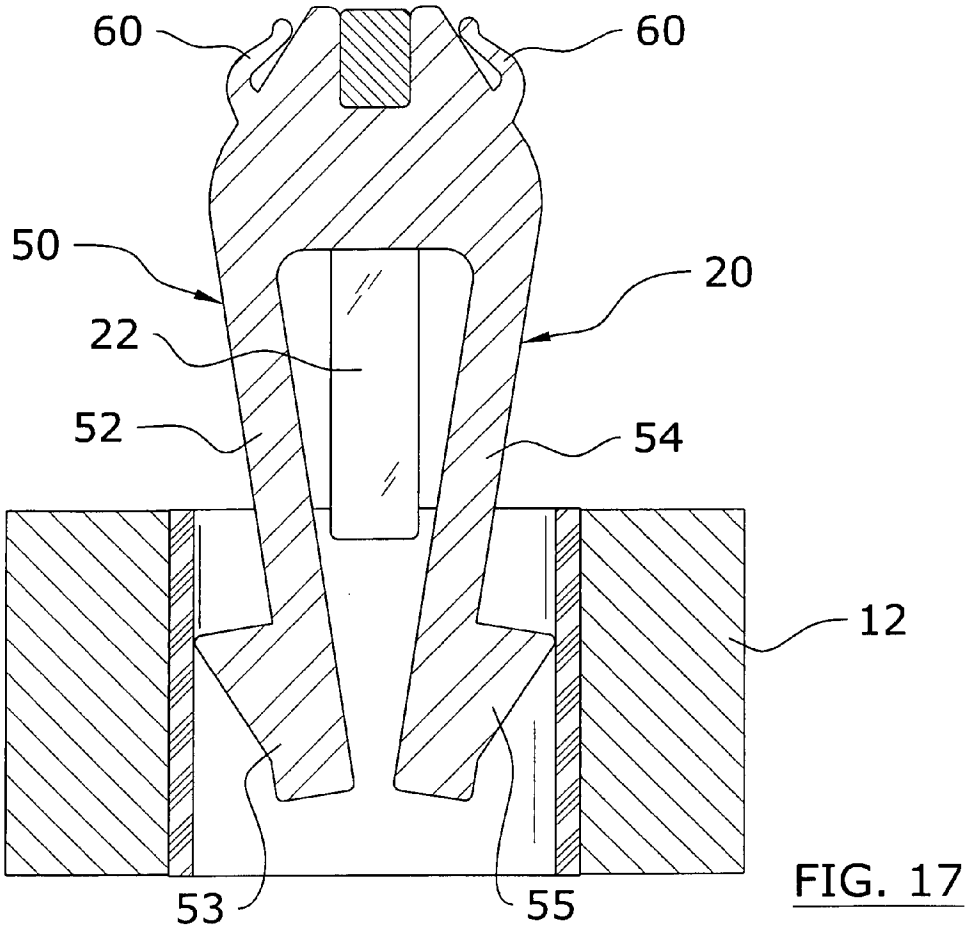
FIG. 17 is an upper perspective view of the main embodiment illustrating the spool partially positioned upon the prongs.

FIGS. 14 and 15 illustrate a second alternative embodiment where the prongs 50 are integrally formed or permanently attached to the support member 30. The prongs 50 may be positioned in a vertical, horizontal or other angled position.

In use, the user retrieves a desired spool 12 and then positions the spool 12 about the distal ends of the prongs 50. The user then forces the core of the spool 12 upon the distal ends of the prongs 50 thereby causing the tapered flanges 53, 55 to engage the inner core of the spool 12. The distal portions of the prongs 50 are thereby forced inwardly toward one another until the inner core of the spool 12 passes the extended most portion of the flanges. The user continues to apply a force upon the spool 12 until fully positioned about the prongs 50 as shown in FIG. 3 of the drawings.

After the outer edge of the spool 12 passes over the first edge 57 and the second edge 59 of the flanges 53, 55, the prongs 50 are free to expand outwardly to substantially their original position thereby securing the spool 12 upon the prongs 50. The user is then free to dispense or load the elongate material as desired by the rotation of the spool 12 about the prongs 50. The user may sever the elongate material by using the cutting edge 32 within the support member 30.

When the user desires to replace the existing spool 12, the user grasps the distal portions of the prongs 50 and applies an inward contracting force upon thereof thereby contracting the prongs 50. When the flanges 53, 55 are able to be passed about by the core of the spool 12 spool 12, the user then simultaneously forces the spool 12 outwardly over the prongs 50 until completely removed. The user then repeats the above process to position the new spool 12 upon the prongs 50.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A material dispenser system, comprising:

a main body having a main slot, wherein said main body is formed for rotatably receiving a spool of material;

a handle structure attached to said main body;

a plurality of resilient prongs removably positionable within said main slot and extending from said main body; and a flange extending from each of said prongs for retaining said spool of material upon said main body.

2. The material dispenser system of claim 1, wherein said plurality of retaining prongs are substantially parallel to one another.

3. The material dispenser system of claim 1, wherein said flange is comprised of a tapered structure narrowing toward a distal end of said prongs.

4. The material dispenser system of claim 3, wherein said flange includes a retaining edge that is in opposition to said spool of material.

5. The material dispenser system of claim 4, wherein said retaining edge is substantially transverse to a radial axis of said spool of material.

6. The material dispenser system of claim 3, wherein said flange begins to broaden a finite distance from a distal end of said prongs.

7. The material dispenser system of claim 1, wherein said plurality of prongs is comprised of a first prong and a second prong in opposition to one another.

8. The material dispenser system of claim 1, wherein said plurality of prongs have a prong slot within a base of said plurality of prongs that receives a portion of said main body.

9. The material dispenser system of claim 8, wherein said plurality of prongs include a plurality of engaging nubs and wherein said main body includes a plurality of catch members that catchably engaging said engaging nubs to retain said plurality of prongs attached to said main body.

10. The material dispenser system of claim 1, wherein said handle structure includes a support member extending from an end of said main body opposite of said open end and a handle attached to a distal end of said support member.

11. The material dispenser system of claim 10, including at least one cutting edge secured within said support member for cutting an elongate material from said spool of material.

12. The material dispenser system of claim 1, including at least one engaging member attached to said plurality of prongs.

13. The material dispenser system of claim 12, wherein said at least one engaging member is comprised resilient structure for frictionally receiving a portion of an elongate material.

14. The material dispenser system of claim 1, wherein said handle structure is substantially parallel to said main body.

15. The material dispenser system of claim 1, including at least one engaging member attached to said main body.

16. The material dispenser system of claim 1, wherein said prongs are comprised of a plastic material.

17. A material dispenser system, comprising:

a main body formed for rotatably receiving a spool of material;

a handle structure attached to said main body;

a plurality of resilient prongs extending from said main body; and a flange extending from each of said prongs for retaining said spool of material upon said main body.

18. A method of operating a material dispenser, said material dispenser comprises a main body formed for rotatably receiving a spool, a handle structure attached to said main body, a plurality of resilient prongs extending from said main body, and a flange extending from each of said prongs for retaining said spool of material upon said main body, said method comprising the steps of:

positioning a core of said spool adjacent the distal ends of said prongs; and forcing said spool over said prongs until retained by said flange of each of said prongs.

19. The method of operating a material dispenser of claim 18, including the steps of:

contracting said plurality of prongs; and removing said spool from said prongs.

* * * * *